United States Patent [19]

Katayama et al.

[11] Patent Number: 4,708,587

[45] Date of Patent: Nov. 24, 1987

[54] CENTRIFUGAL COMPRESSOR

[75] Inventors: Kazuso Katayama; Taku Ichiryuu; Yasushi Mouri; Tsuneyoshi Mitsuhashi; Masanori Kobayashi, all of Takasago, Japan

[73] Assignee: Mitsubishi Jukogyo Kabushiki Kaisha, Tokyo, Japan

[21] Appl. No.: 832,680

[22] Filed: Feb. 25, 1986

[30] Foreign Application Priority Data

Jun. 20, 1985 [JP] Japan ..... 60-92283

[51] Int. Cl.[4] ..... F01D 3/04

[52] U.S. Cl. ..... 415/104

[58] Field of Search ..... 415/104, 105, 106, 107, 415/96

[56] References Cited

U.S. PATENT DOCUMENTS

| | | | |
|---|---|---|---|
| 785,039 | 3/1905 | Hopkinson et al. | 415/106 |
| 1,485,504 | 3/1924 | Hollander | 415/106 |
| 1,499,056 | 6/1924 | Hollander | 415/104 |
| 3,718,406 | 2/1973 | Onal | 415/219 C |
| 3,788,764 | 1/1974 | Shuey et al. | 415/104 |
| 3,861,825 | 1/1975 | Blom | 415/104 |

FOREIGN PATENT DOCUMENTS

| | | | |
|---|---|---|---|
| 681087 | 8/1939 | Fed. Rep. of Germany | 415/106 |
| 19470 | of 1906 | United Kingdom | 415/106 |
| 48109 | 9/1981 | U.S.S.R. | 415/106 |

*Primary Examiner*—Robert E. Garrett
*Assistant Examiner*—John Kwon
*Attorney, Agent, or Firm*—Birch, Stewart, Kolasch, & Birch

[57] ABSTRACT

A centrifugal compressor includes an impeller of a make-up (compressing) pump stage, a first balancing ring for generating axial thrust on an impellar shaft for balancing the axial thrust generated by the make-up pump stage, an impeller of a recycle stage and a second balancing ring disposed between the make-up pump stage and the recycle stage. The impellers and balancing rings are fixedly mounted on the same impellar shaft in a common casing. The diameters of the first and second balancing ring and a liner ring disposed at a suction side of the impeller of the recycle stage are substantially identical with each other.

3 Claims, 1 Drawing Figure

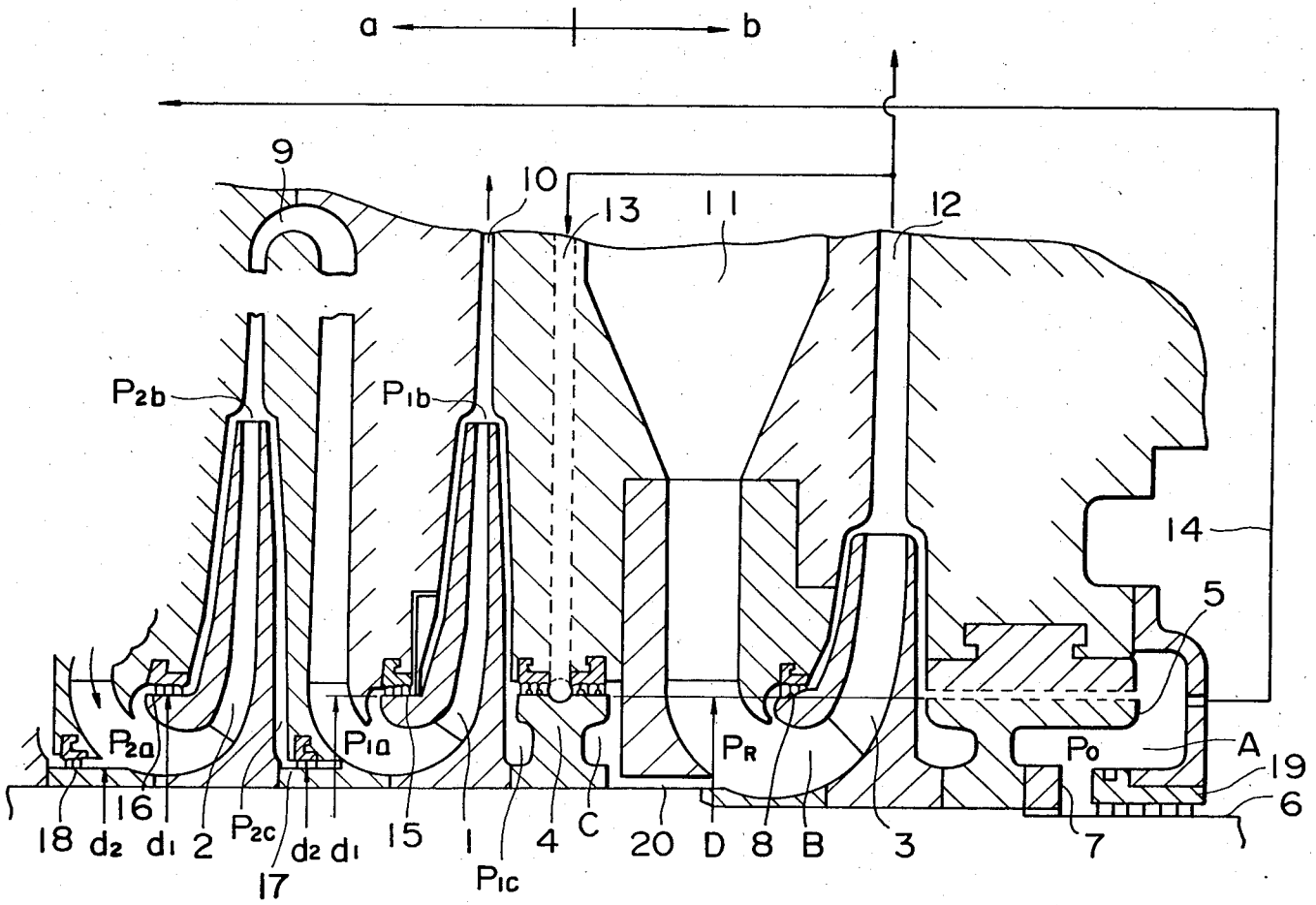
a
b
9
10
11
12
13
14
5
A
19
6
7
$P_o$
3
B
8
D
$P_R$
20
C
4
$P_{1c}$
1
15
$P_{1a}$
$P_{1b}$
$d_2$ $d_1$
17
$P_{2c}$
2
16
$P_{2a}$
$P_{2b}$
$d_1$
$d_2$
18

CENTRIFUGAL COMPRESSOR

FIELD OF THE INVENTION

The present invention relates to a centrifugal compressor, and more particularly, to a centrifugal compressor including a make-up (compressing) pump stage and a recycle (recirculation) stage.

In previously existing centrifugal compressors having a make-up pump stage for increasing gas pressure from low pressure to high pressure and a recycle pump stage for recirculating gas, for example, in a process reactor, the difference between the axial thrust generated by the make-up pump stage and the axial thrust generated by the recycle pump stage is offset by the axial thrust generated by a balancing ring to balance them.

In the above described prior art centrifugal compressor, the thrusts exerted on the impeller shaft are balanced with each other during rated operation. However, when the operation is stopped, while pressure of gas by the make-up pump stage is suddenly reduced, pressure by the recycle stage is not readily reduced since capacity for gas in the recycle system is large. Accordingly, the balance of the thrust is transiently lost and excessive thrust by the impeller shaft is applied to a thrust bearing. Further, when performance of a cooling unit disposed in the recycle system is changed, the balance of the forces may be lost.

In other to remove the above mentioned problem, it has been proposed that the thrust bearing be made large to compensate for the thrust exerted on the bearing that may become substantially large. However, the frictional loss by the thrust bearing becomes disadvantageously increased.

While it has been further proposed that an alarm is issued when the difference between pressures of gas in the make-up stage and the recycle stage exceeds a predetermined value, the rate of operation is reduced:

SUMMARY OF THE INVENTION

Therefore, it is an object of the present invention to provide an improved centrifugal compressor having means for balancing axial thrust not only during rated operation of the centrifugal compressor but also during transient periods such as starting and stopping of the compressor or during periods of changing conditions of operation of the centrifugal compressor.

Another object of the present invention is to produce a centrifugal compressor comprising an impeller of a make-up pump stage, a first balancing ring for generating axial thrust balanced with axial thrust generated by the make-up pump stage, an impeller of a recycle stage and a second balancing ring disposed between the make-up pump stage and the recycle stage, whereby the impellers and the balancing rings are fixedly mounted on the same shaft in the same chamber, and the diameters of the first and second balancing rings and a liner ring disposed at a suction side of the impeller of the recycle stage are substantially identical.

Still, another object of the present invention is to produce a centrifugal compressor having an impeller shaft balancing system in which the first balancing ring generates axial thrust which is balanced with an axial thrust generated by the make-up stage and the diameters of the first balancing ring, the second balancing ring, which is disposed between the recycle stage and the make-up stage, and a liner ring disposed at the suction side of the impeller of the recycle stage are substantially identical with each other whereby the recycle stage can maintain the balance of the axial thrust independently of the make-up stage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which is given by way of illustration only, and thus are not limitative of the present invention, and wherein:

The sole drawing shows a fragmentary longitudinal sectional view illustrating an embodiment of the present invention.

DESCRIPTION OF PREFERRED EMBODIMENT

The present invention is now described in more detail with reference to the drawing showing an embodiment of the present invention.

As shown in the FIGURE, a make-up pump stage a increases pressure of gas entering stage a from low pressure to high pressure and a recycle stage b recirculates gas of for example a process reactor. There are generally provided many make-up stages, while only a last stage and a stage preceding the last stage are shown. The recycle stage is generally a single stage. An impeller 1 of the last make-up stage a, an impeller 2 of the preceding make-up stage, an impeller 3 of the recycle stage b, a first balancing ring 5 and a second balancing ring 4 disposed between the make-up stage a and the recycle stage b are fitted on the same shaft 6 in the same casing and are fixed on the shaft 6 by means of a fastener such as by a nut 7. The diameters of the second balancing ring 4 and a liner ring 8 disposed at a suction side of the impeller 3 of the recycle stage b are equal to a diameter D of the first balancing ring 5.

Gas flowing through the impeller 2 is sucked into the impeller 1 through a diffuser 9 and discharged from the diffuser 10 after flowing through the impeller 1. Gas of the recycle system is sucked through a suction inlet 11 and flows through the impeller 3. The gas flowing through the impeller 3 is then discharged from a diffuser 12.

Part of the discharged gas is supplied through a throughhole 13 into the second balancing ring 4 to prevent gas in the make-up stage from entering into the recycle stage b. The throughhole 13 is not an indispensable element when the present invention is implemented.

A chamber A disposed at the right side of the first balancing ring 5 is coupled through a pipe 14 to a suction inlet of a first make-up stage.

Numerals 15 and 17 denote a liner ring and a diaphragm bushing in the last make-up stage, respectively, numerals 16 and 18 denote a liner ring and a diaphragm bushing in the preceding make-up stage, respectively, and numeral 19 denotes a labyrinth.

The total axial thrust exerted on the shaft by the recycle stage is always zero.

Within diameter D, since a suction chamber B of the impeller 3 communicates with a chamber C of the second balancing ring 4 through a passageway 20, pressure in the chambers B and C is equal to suction pressure $P_R$ and since the diameter D of the liner ring 8 of the impeller 3 is equal to the diameter D of the second balancing ring 4, axial thrust pressing the second balancing ring 4 in the left direction by suction pressure $P_R$ balances with axial thrust pressing the impeller 3 in the right direction. Outside diameter D, since pressure exerted on a back surface of a main plate of the impeller 3 and pressure exerted on a back surface of a side plate are substantially identical and exerted in opposite directions to each other and the diameter D of the liner ring 8 is equal to the diameter D of the first balancing ring 5, axial thrust based on these pressures is not effected. Further, since force pressing the impeller 3 in the left direction and force pressing the first balancing ring 5 in the right direction are equal to each other in the absolute value and exerted in opposite directions to each other, each force is offset by the other. Accordingly, the total axial thrust exerted on the shaft 6 by the recycle stage b is always zero. In other words, axial thrust produced in he recycle stage balances independently of the make-up stage.

The diameter D of the first balancing ring 5 is defined so that the axial thrust by the first balancing ring 5 is balanced with the axial thrust by the make-up stage.

Axial thrust of the impeller 2 in the make-up stage is now considered.

The axial thrust F2*r* pressing the impeller 2 in the right direction is expressed by $$F2r=\pi(d1^2-d2^2)P2a/4$$

where d1 is the diameter of the liner ring 16, d2 is the diameter of the diaphragm bushing 18 and P2*a* is a suction pressure.

On the other hand, the axial thrust F2*l* pressing the impeller 2 in the left direction is expressed by $$F2l=\pi(d1^2-d2^2)P2c/4$$

where d2 is the diameter of the liner ring 15 and P2*c* is pressure exerted on the main plate of the impeller 2 and which approximates to discharged pressure P2*b* but is slightly different due to the influence of rotation of the impeller 2 being exerted thereon.

Outside diameter d1, since pressure exerted on the back surface of the main plate of the impeller 2 and pressure exerted on the back surface of the side plate thereof are substantially identical and exerted in the opposite directions to each other, axial thrust based on these pressures is not a factor.

Thus, axial thrust directed in the right direction by the force of F2*r*−F2*l* is exerted on the impeller 2. Similarly, axial thrust directed to the left is exerted on the impeller 2 by other make-up stages.

Axial thrust F1*r* pressing the impeller 1 of the last make-up stage in the right direction is given by $$F1r=\pi(d1^2-d2^2)P1a/4$$

where d1 is the diameter of the liner ring 15, d2 is the diameter of the diaphragm bushing 17 and P1*a* is a suction pressure.

On the other hand, axial thrust F1*l* acting on the impeller 1 and the second balancing ring in the make-up stage to the left direction is given by $$F1l=\pi(d1^2-D^2)P1c/4$$

where d1 is the diameter of the liner ring 15, D is the diameter of the second balancing ring and P1*c* is pressure approximating to pressure P1*b* exerted on the main plate of the impeller 1 and however slightly different due to the influence of rotation of the impeller 1 being exerted thereon.

When pressure (absolute pressure) in the right side chamber A of the first balancing ring 5 is P, axial thrust Fb*l* pressing the first balancing ring 5 in the left direction is given by $$Fbl-\pi(D^2-do^2)P/4$$

where D is the diameter of the first balancing ring and do is the diameter of the impeller shaft.

Accordingly, the condition where axial thrust pressing the shaft 6 in the right direction is zero, when the number of stages of the impellers of the make-up stage is two, is given by $$F2r-F2l+F1r-F1l+Fbl=0$$

The diameter D satisfying the above equation can be defined theoretically or experimentally. When the number of stages of impellers of the make-up stage is three or more, the value D is similarly defined. The chamber A at the right hand side of the first balancing ring 5 is not necessarily required to communicate with the first make-up stage and can communicate with, for example, the intermediate of the first and second make-up stage.

As described above, each of the make-up stages produces axial thrust on the shaft directed to the left and the diameter D of the first balancing ring 5 is defined to produce thrust corresponding to the sum of axial thrust produced by each of the make-up stages. Accordingly, axial thrust of the make-up stage balances with the axial thrust produced by the first balancing ring 5 independently of the recycle stage. Since axial thrust produced in the make-up tage and axial thrust produced by the first balancing ring 5 are both proportional to the suction pressure of the first make-up stage and discharge pressure of the last make-up stage, variation of axial thrust is slight even if operating conditions of the make-up stage is changed.

When the centrifugal compressor is stopped, even if gas pressure in the make-up stage is rapidly reduced and gas pressure in the recycle stage is not rapidly reduced, since axial thrust by the make-up stage and axial thrust by the recycle stage balance independently of each other, excessive axial thrust is not exerted on the thrust bearing. Further, even if the operating point of the make-up stage or the recycle stage is shifted from the rated operating point independently of each other due to variation of operating condition of the make-up stage or the recycle stage during operation of the centrifugal compressor, excessive axial thrust is not exerted on the thrust bearing similarly.

EFFECTS OF THE INVENTION (i) Since axial thrust by the make-up stage balances with axial thrust by the first balancing ring and axial thrust of the recycle stage balances independently of the make-up stage, excessive axial thrust is prevented from being exerted on the thrust bearing due to variations of the operating conditions of the make-up stage in operation and upon starting or stopping of the centrifugal compressor.

(ii) Application of the present invention hardly increases the cost of the centrifugal compressor and the cost can be rather reduced by elimination of an alarm unit and improved working ratio.

We claim:

1. A centrifugal compressor comprising:

a casing having a make-up stage and a recycle stage;

a shaft rotatably supported within said casing;

a make-up stage impeller fixedly mounted to said shaft for rotation, said make-up stage impeller being disposed within said make-up stage of said casing;

a recycle stage impeller fixedly mounted to said shaft for rotation, said recycle stage impeller being disposed within said recycle stage of said casing;

a first, balancing ring fixedly mounted to said shaft for rotation, said first balancing ring being disposed within said recycle stage of said casing;

a second balancing ring fixedly mounted to said shaft for rotation, said second balancing ring being disposed between said make-up stage and said recycle stage of said casing; and a liner ring disposed between said recycle stage impeller and said recycle stage of said casing;

wherein diameters of said first balancing ring, said second balancing ring and said liner ring are substantially the same.

2. The centrifugal compressor according to claim 1, including at least one additional make-up stage comprising an additional make-up stage impeller for providing a multi-stage compressor for increasing a differential pressure obtainable from said compressor between inlet and exist fluid pressure.

3. A centrifugal compressor comprising:

a casing having a make-up stage and a recycle stage;

a shaft rotatably supported within said casing;

a make-up stage impeller fixedly mounted to said shaft for rotation, said make-up stage impeller being disposed within said make-up stage of said casing;

a recycle stage impeller fixedly mounted to said shaft for rotation, said recycle stage impeller being disposed within said recycle stage of said casing;

a first balancing ring fixedly mounted to said shaft for rotation, said first balancing ring being disposed within said recycle stage of said casing;

a second balancing ring fixedly mounted to said shaft for rotation, said second balancing ring being disposed between said make-up stage and said recycle stage of said casing; and a liner ring disposed between said recycle stage impeller and said recycle stage of said casing;

wherein said first balancing ring is adapted for generating an axial force on said shaft for balancing with an axial force exerted on said shaft by said make-up pump stage, and wherein said second balancing ring is adapted for generating an axial thrust on said shaft for balancing with an axial force exerted on said shaft by said recycle stage for balancing said centrifugal compressor through its operational range.

* * * * *